US007217485B2

(12) United States Patent
Hasegawa et al.

(10) Patent No.: US 7,217,485 B2
(45) Date of Patent: May 15, 2007

(54) TONER FOR ELECTROPHOTOGRAPHY, AND IMAGE FIXING PROCESS, IMAGE FORMING PROCESS, IMAGE FORMING APPARATUS AND PROCESS CARTRIDGE USING THE SAME

(75) Inventors: Kumi Hasegawa, Shizuoka (JP); Mitsuo Aoki, Shizuoka (JP); Bing Shu, Shizuoka (JP); Toyoshi Sawada, Kanagawa (JP); Keiko Shiraishi, Shizuoka (JP); Masashi Nagayama, Shizuoka (JP); Shinichi Kuramoto, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 315 days.

(21) Appl. No.: 10/800,636

(22) Filed: Mar. 16, 2004

(65) Prior Publication Data

US 2004/0234879 A1 Nov. 25, 2004

(30) Foreign Application Priority Data

Mar. 17, 2003 (JP) ..... 2003-072674

(51) Int. Cl.
*G03G 9/08* (2006.01)
*G03G 15/20* (2006.01)

(52) U.S. Cl. ..... 430/108.3; 430/108.6; 430/109.4; 430/111.4; 430/124; 399/320

(58) Field of Classification Search ..... 430/108.3, 430/108.6, 109.1, 109.4, 111.4, 124; 399/320
See application file for complete search history.

(56) References Cited

U.S. PATENT DOCUMENTS 4,764,447 A 8/1988 Tsubuko et al.
4,860,050 A 8/1989 Kurotori et al.
4,908,290 A 3/1990 Watanabe et al.
4,925,763 A 5/1990 Tsubuko et al.
4,933,250 A 6/1990 Nakayama et al.
4,956,258 A 9/1990 Watanabe et al.
4,957,842 A 9/1990 Fukase et al.
4,980,258 A 12/1990 Aoki et al.
4,985,733 A 1/1991 Kurotori et al.
5,026,621 A 6/1991 Tsubuko et al.
5,061,587 A 10/1991 Tsubuko et al.
5,061,588 A 10/1991 Fushimi et al.
5,099,289 A 3/1992 Kurotori et al.
5,169,739 A 12/1992 Umemura et al.
5,189,102 A 2/1993 Tsubuko et al.
5,199,983 A * 4/1993 Katamoto ..... 106/459
5,225,302 A 7/1993 Isoda et al.
5,328,794 A 7/1994 Kazuo et al.
5,370,959 A 12/1994 Hagiwara et al.
5,380,616 A 1/1995 Aoki et al.
5,403,690 A 4/1995 Kuramoto et al.
5,474,869 A 12/1995 Tomita et al.
5,482,807 A 1/1996 Aoki et al.
5,519,316 A 5/1996 Hagiwara et al.
5,541,031 A 7/1996 Yamashita et al.
5,545,381 A 8/1996 Iida et al.
5,547,793 A 8/1996 Kuramoto et al.
5,554,478 A 9/1996 Kuramoto et al.
5,574,538 A 11/1996 Takahashi et al.
5,576,393 A 11/1996 Yamashita et al.
5,605,777 A 2/1997 Ando et al.
5,612,766 A 3/1997 Iida et al.
5,614,347 A 3/1997 Aoki et al.
5,747,210 A 5/1998 Emoto et al.
5,750,299 A 5/1998 Ohshima et al.
5,753,400 A 5/1998 Kuramoto et al.
5,759,733 A 6/1998 Tsubuko et al.
5,851,716 A 12/1998 Kuramoto et al.
5,912,100 A 6/1999 Aoki et al.
5,994,016 A 11/1999 Kuramoto et al.
5,998,073 A 12/1999 Kuramoto et al.
6,004,715 A 12/1999 Suzuki et al.
6,047,758 A 4/2000 Kuramoto et al.
6,060,201 A 5/2000 Kinoshita et al.
6,074,795 A 6/2000 Watanabe et al.
6,095,164 A 8/2000 Saitoh et al.
6,103,441 A 8/2000 Tomita et al.
6,120,960 A 9/2000 Aoki et al.
RE36,963 E 11/2000 Ando et al.
6,168,894 B1 1/2001 Aoki et al.
6,180,298 B1 1/2001 Kuroda et al.
6,221,549 B1 4/2001 Emoto et al.
RE37,197 E 5/2001 Iida et al.
6,248,488 B1 6/2001 Kinoshita et al.
6,255,028 B1 7/2001 Hasegawa et al.
6,268,098 B1 7/2001 Sugimoto et al.
6,274,282 B1 8/2001 Sugimoto et al.
6,303,257 B1 10/2001 Hasegawa et al.
6,360,068 B1 3/2002 Kinoshita et al.

(Continued)

*Primary Examiner*—John L Goodrow
(74) *Attorney, Agent, or Firm*—Oblon, Spivak, McClelland, Maier & Neustadt, P.C.

(57) ABSTRACT

A toner for electrophotography contains a binder resin, a charge control agent, and a colorant. The colorant is a black iron oxide compound containing 10 to 45% by weight of titanium component calculated in terms of Ti atom in relation to Fe atom when measured by wavelength dispersive X-ray fluorescence spectrometry. Peaks at Bragg angle 2θ of the toner to CuKα X-ray are peak A at 32.9 degrees ±0.3 degrees and peak B at 35.5 degrees ±0.3 degrees, and X ray intensity ratio between peaks A and B (A/B) is in the range of 0.3 to 2.0 at a scan speed of 0.5 to 4 degrees/min.

18 Claims, 2 Drawing Sheets

U.S. PATENT DOCUMENTS

| | | | | |
|---|---|---|---|---|
| 6,363,229 | B1 | 3/2002 | Shiraishi et al. | |
| RE37,645 | E | 4/2002 | Takahashi et al. | |
| 6,403,275 | B1 | 6/2002 | Kuramoto et al. | |
| 6,416,914 | B1 | 7/2002 | Nakamura et al. | |
| 6,432,589 | B1 | 8/2002 | Uchinokura et al. | |
| 6,432,590 | B1 | 8/2002 | Ueda et al. | |
| 6,468,706 | B2 | 10/2002 | Matsuda et al. | |
| 6,544,704 | B1 | 4/2003 | Matsuda et al. | |
| 6,566,026 | B2 | 5/2003 | Watanabe et al. | |
| 6,593,048 | B2 | 7/2003 | Sasaki et al. | |
| 6,653,037 | B2 | 11/2003 | Sawada et al. | |
| 6,667,141 | B2 | 12/2003 | Iwamoto et al. | |
| 6,699,632 | B2 | 3/2004 | Shu et al. | |
| 6,716,561 | B2 | 4/2004 | Shiraishi et al. | |
| 6,737,210 | B2 | 5/2004 | Uchinokura et al. | |
| 6,844,067 | B2 * | 1/2005 | Shimo et al. | 428/402 |
| 6,969,574 | B1 * | 11/2005 | Tosaka et al. | 430/137.18 |
| 2003/0036010 | A1 | 2/2003 | Suzuki et al. | |
| 2003/0165765 | A1 | 9/2003 | Yamashita et al. | |
| 2003/0186155 | A1 * | 10/2003 | Aoki et al. | 430/111.4 |

* cited by examiner

TONER FOR ELECTROPHOTOGRAPHY, AND IMAGE FIXING PROCESS, IMAGE FORMING PROCESS, IMAGE FORMING APPARATUS AND PROCESS CARTRIDGE USING THE SAME

BACKGROUND OF THE INVENTION

1. Field of the Invention

The present invention relates to a toner for developing an electrostatic latent image which is adapted for use in electrophotography or the like; a process cartridge housing such a toner; an image forming apparatus used with such a toner; an image foxing process using such a toner; and an image forming process using such a toner.

2. Description of the Related Art

Various electrophotographic processes have been proposed including those described in U.S. Pat. No. 2,297,691, Japanese Patent Application Publication (JP-B) Nos. 49-23910 and 43-24748. An electrophotography, however, is generally a process accomplished by forming a latent electrostatic image on a photoconductor by various means utilizing the photoconductor material, developing the latent image by using dry toner, transferring the toner image to a paper or the like, and fixing the transferred image by applying heat, pressure, or the like to thereby produce a photocopy.

The processes used for developing the latent electrostatic image can be roughly categorized into a liquid development process using a developer wherein various pigments and dies are finely dispersed in an insulating organic liquid, and a dry development process such as cascade development, magnetic brush development, and powder cloud development wherein a toner having carbon black or other colorants dispersed in a natural or synthetic resin is used. The dry development process includes a single component development process and a two component development process wherein a carrier is used together with the toner.

The process used for thermally fixing the toner image onto the transfer paper can be generally categorized into contact fixing and non-contact fixing methods. The contact fixing method includes those using a heat roller and those using a belt. The non-contact fixing method includes a flash fixing and an oven (atmospheric) fixing.

The fixing method using a heat roller is highly effective since the toner image and the heat roller are brought into direct contact with each other, and this enables the production of compact apparatus. Accordingly, this method is widely employed.

However, because of the recent requirement for higher energy efficiency, a heat source is often turned off during the waiting period when no fixing is conducted. In such apparatus, heating of the heat roller should start as soon as the heat source is turned on and the predetermined desirable temperature should be attained in a very short period.

In the case of the fixing unit used in such apparatus, attempts have been made to reduce the thickness of the fixing roller that becomes in contact with the toner image-bearing surface to the level of 1.0 mm or less to thereby improve the thermal energy efficiency (Japanese Patent Application Laid-Open (JP-A) Nos. 2002-82474 and 09-222750). Such attempts have paid off, and the time required to attain the predetermined desirable temperature has been reduced to a very short period.

Reduction of the thickness of the fixing roller to the level of 1.0 mm or less, however, resulted in the loss of the mechanical strength of the roller itself. A large load cannot be applied to the roller because the roller is deformed by such a large load.

This situation requires a toner adapted for use of such a fixing unit having a low temperature fixability of the level incomparable to the conventional toners.

Various technical proposals have been made to solve such situation.

For example, Japanese Patent (JP-B) No. 2743476 proposes a toner adapted for use in roller fixing, wherein the toner comprises a core particle consisting of a polyester resin and a wax having a polar group and the core particle is coated with a resin, and in this patent, the polyester resin and the wax are defined for their melt viscosity. JP-A Nos. 03-122661, 04-85550, and JP-B No. 08-16804 disclose toners to be fixed on a film, comprising a particular polyester and a particular release agent, and in these applications, the melt viscosity of the polyester resin at 80° C. to 120° C., the gradient of the curve of the melt viscosity in relation to the temperature, and the melt viscosity of the release agent are defined. JP-B No. 08-12459 proposes a capsule toner to be fixed on a film, comprising a particular polyester resin and a particular release agent, and in this application, the melt viscosity of the polyester resin at 80° C. to 120° C., the gradient of the curve of the melt viscosity in relation to the temperature, and the melt viscosity of the release agent are defined. JP-B No. 07-82250 discloses a toner be fixed on a film, comprising a particular polyester resin, a particular organometallic compound, and a particular release agent, and in this application, the melt viscosity of the polyester resin at 120° C. to 150° C., the gradient of the curve of the melt viscosity in relation to the temperature, and the melt viscosity of the release agent are defined. JP-B No. 07-72809 proposes a toner comprising a styrene-acryl resin, and in this application, the relation between the melt viscosity measured at 110° C. to 130° C. and the temperature are defined. JP-A No. 10-246989 proposes a toner comprising a particular charge control agent, and in this application, the average viscosity gradient of the toner is defined.

In addition, corresponding to the demand for the reproduction of a high quality image, there has been a trend towards the toner particle size to be reduced. A toner with a smaller particle size is known to have a poor fixability since it becomes difficult to apply a sufficient pressure to such small toner particles between fixing rollers. This trend is even more significant in the fixing unit operated at a low bearing force.

Attempts have also been made to replace carbon black with other colorants, for example, fine powders of black metal compounds with high safety and good thermal conductivity.

For example, JP-B No. 2736680 proposes a mixture of $Fe_2TiO_5$ and $Fe_2O_3$-$FeTiO_3$ solid solution having an average particle size of 0.1 μm to 0.5 μm; JP-B Nos. 3101782, 3108823, and 3174960 disclose a magnetic iron oxide comprising 25% to 30% of FeO; JP-B Nos. 3224774 and 3261088 propose a magnetite having a residual magnetization of 6 emu/g or less; JP-A No. 2000-319021 discloses iron oxide particles wherein the interior comprises Ti, and the surface comprises Ti and Fe; JP-A No. 2002-129063 discloses a rutile $TiO_2$ mixed phase crystal having a saturation magnetization of 0.5 emu/g to 10 emu/g and a particle size of 0.1 μm to 0.4 μm; JP-A No. 2002-189313 proposes a metal compound having a saturation magnetization of 30 emu/g or less and a dielectric loss of 50 or less; and JP-A No. 2002-196528 discloses a metal compound having a saturation magnetization of 40 emu/g or less used at a content of 20 parts by weight or less; and JP-A No. 2000-10344 discloses black hematite fine particles and black hydrous iron oxide fine particles.

However, when the fixing unit having a roller with reduced thickness operated at a low bearing force is used to correspond to the increasing demand of energy saving, toners produced by the prior art technologies are far from being sufficient to realize the required fixability.

In addition, the colorants used as substitutes for the carbon black have been insufficient in electroconductivity, and the charge build up speed and stability thereof have been insufficient.

SUMMARY OF THE INVENTION

The present invention provides a toner produced by using a novel black colorant instead of the conventional carbon black. An object of the present invention is to provide a toner for electrophotography which exhibits sufficient electroconductivity and good charging performance without incorporating the carbon black.

Another object of the present invention is to provide a toner for electrophotography which exhibits excellent fixability and high temperature storage life even when used with the fixing unit having a roller with a reduced thickness operated at a low bearing force; a process cartridge utilizing such a toner; an image fixing process using such a toner at a high thermal energy efficiency and at a high fixability; and an image forming process using such a toner.

In view of the situation as described above, the first aspect of the present invention is a toner for electrophotography which comprises a binder resin, a charge control agent, and a colorant. In this aspect, the colorant is a black iron oxide compound containing from 10% by weight to 45% by weight of titanium component calculated in terms of Ti atom in relation to Fe atom when measured by wavelength dispersive X-ray fluorescence spectrometry. Peaks at Bragg angle 2θ of the toner to CuKα X-ray are peak A at 32.9 degrees±0.3 degrees and peak B at 35.5 degrees±0.3 degrees, and the intensity ratio of the CuKα X-ray between peaks A and B (A/B) is in the range of 0.3 to 2.0 at a scan speed of 0.5 to 4 degree/min.

The second aspect of the present invention is a toner according to the first aspect, wherein the colorant is a black iron oxide compound containing from 12% by weight to 35% by weight of titanium component calculated in terms of Ti atom is relation to Fe atom when measured by wavelength dispersive X-ray florescence spectrometry.

The third aspect of the present invention is a toner according to the first aspect, wherein the intensity ratio of the CuKα X-ray between peaks A and B (A/B) is in the range of 0.6 to 1.8.

The fourth aspect of the present invention is a toner according to the first aspect, wherein the colorant has a saturation magnetization σs of from 0.5 emu/g to 30 emu/g.

The fifth aspect of the present invention is a toner according to the first aspect, wherein the black iron oxide compound has an average primary particle size of from 0.05 μm to 2.0 μm.

The sixth aspect of the present invention is a toner according to the first aspect, wherein the black iron oxide compound has at least one of a black dye, a black pigment, a blue dye and a blue pigment immobilized on the surface thereof.

The seventh aspect of the present invention is a toner according to the first aspect, wherein the toner has the black iron oxide compound content of from 10% by weight to 30% by weight.

The eighth aspect of the present invention is a toner according to the seventh aspect, wherein the toner has the black iron oxide compound content of from 10 parts by weight to 40 parts by weight with respect to 100 parts by weight of the binder resin.

The ninth aspect of the present invention is a toner according to the first aspect, wherein the binder resin comprises a resin (A) and a resin (B), having mutually different softening points. The resin (A) and the resin (B) respectively have softening points Tm(A) and Tm(B), glass transition points Tg(A) and Tg(B), satisfying the following relations:

$$Tm(A)>Tm(B);$$

$$|Tg(A)-Tg(B)|<10^\circ \text{ C.; and}$$

$$30<Tm(A)-Tm(B)\leqq 60^\circ \text{ C.}$$

The tenth aspect of the present invention is a toner according to the ninth aspect, wherein the softening points Tm(A) and Tm(B) and the glass transition points Tg(A) and Tg(B) satisfy the following relations:

$$|Tg(A)-Tg(B)|<7^\circ \text{ C.; and}$$

$$35\leqq Tm(A)-Tm(B)\leqq 55^\circ \text{ C.}$$

The eleventh aspect of the present invention is a toner according to the first aspect, wherein the binder resin comprises a polyester rein.

The twelfth aspect of the present invention is a toner according to the first aspect, wherein the charge control agent comprises a zirconium compound which comprises zirconium and one of aromatic hydroxycarboxylic acid and a salt thereof.

The thirteenth aspect of the present invention is a toner according to the first aspect, wherein the toner has a volume average particle size of 4 μm to 7.5 μm, and the toner has 60% by number to 80% by number of toner particles having a particle size of 5 μm or less.

The fourteenth aspect of the present invention is an image fixing process which comprises the step of passing a substrate bearing a toner image on the surface thereof between two rollers, one of the two rollers being a fixing roller that becomes in contact with the toner image-bearing surface of the substrate, to thereby fix the toner image on the substrate. In this aspect, the toner image is formed with the toner according to the first aspect of the present invention, and the two rollers are applied with a bearing force (load applied to the rollers/contact area) of $1.5\times10^5$ Pa or less, and the fixing roller has a thickness of 1.0 mm or less.

The fifteenth aspect of the present invention is an image forming process which comprises the steps of: charging a photoconductor; irradiating the photoconductor imagewise with light so as to form a latent electrostatic image thereon; developing the latent electrostatic image using a toner so as to form a toner image; transferring the toner image on the photoconductor to a substrate so as to bear the toner image on the surface of the substrate; and passing the substrate bearing the toner image between two rollers, one of the two rollers being a fixing roller that becomes in contact with the toner image-bearing surface of the substrate, to thereby fix the toner image on the substrate. In this aspect, the toner is the toner according to the first aspect of the present invention, and the two rollers are applied with a bearing force (load applied to the rollers/contact area) of $1.5\times10^5$ Pa or less, and the fixing roller has a thickness of 1.0 mm or less.

The sixteenth aspect of the present invention is an image forming process wherein comprises the steps of: contacting a charging member disposed in a charging unit with a photoconductor and applying a voltage to the charging member so as to charge the photoconductor; irradiating the photoconductor imagewise with light so as to form a latent electrostatic image thereon; applying a toner to the photoconductor so as to develop the latent electrostatic image with forming a toner image; and heating and pressurizing the substrate bearing the toner image so as to fix the toner image on the substrate. In this aspect, the toner is the toner according the first aspect of the present invention.

The seventeenth aspect of the present invention is an image forming apparatus which comprises a photoconductor; a charging unit configured to charge the photoconductor; an irradiating unit configured to irradiate the photoconductor imagewise with the light so as to form a latent electrostatic image on the photoconductor; a developing unit, which houses a toner therein, configured to develop the latent electrostatic image using the toner so as to form a toner image; a transferring unit configured to transfer the toner image on the photoconductor to a substrate; and a fixing unit, which comprises two rollers, configured to pass the substrate bearing the toner image between the two rollers so as to fix the toner image on the substrate. In this aspect, the toner is the toner according to the first aspect of the present invention, and the two rollers are applied with a bearing force (load applied to the rollers/contact area) of $1.5\times10^5$ Pa or less, and the fixing roller is subjected to a contact with the toner image-bearing surface of the substrate when the substrate is passed through between the two rollers.

The eighteenth aspect of the present invention is a process cartridge which comprises a photoconductor, and at least one unit selected from: a charging unit configured to charge the photoconductor; a developing unit, which houses a toner therein, configured to develop a latent electrostatic image formed on the photoconductor using the toner so as to form a toner image; and a cleaning unit, which comprises a cleaning blade, configured to remove the residual toner on the photoconductor using the cleaning blade after the toner image is transferred from the photoconductor, so as to clean the photoconductor. In this aspect, the process cartridge is detachably mountable to a main body of an image forming apparatus, and the toner is the toner according to the first aspect of the present invention.

DESCRIPTION OF THE PREFERRED EMBODIMENTS

Figure 1:
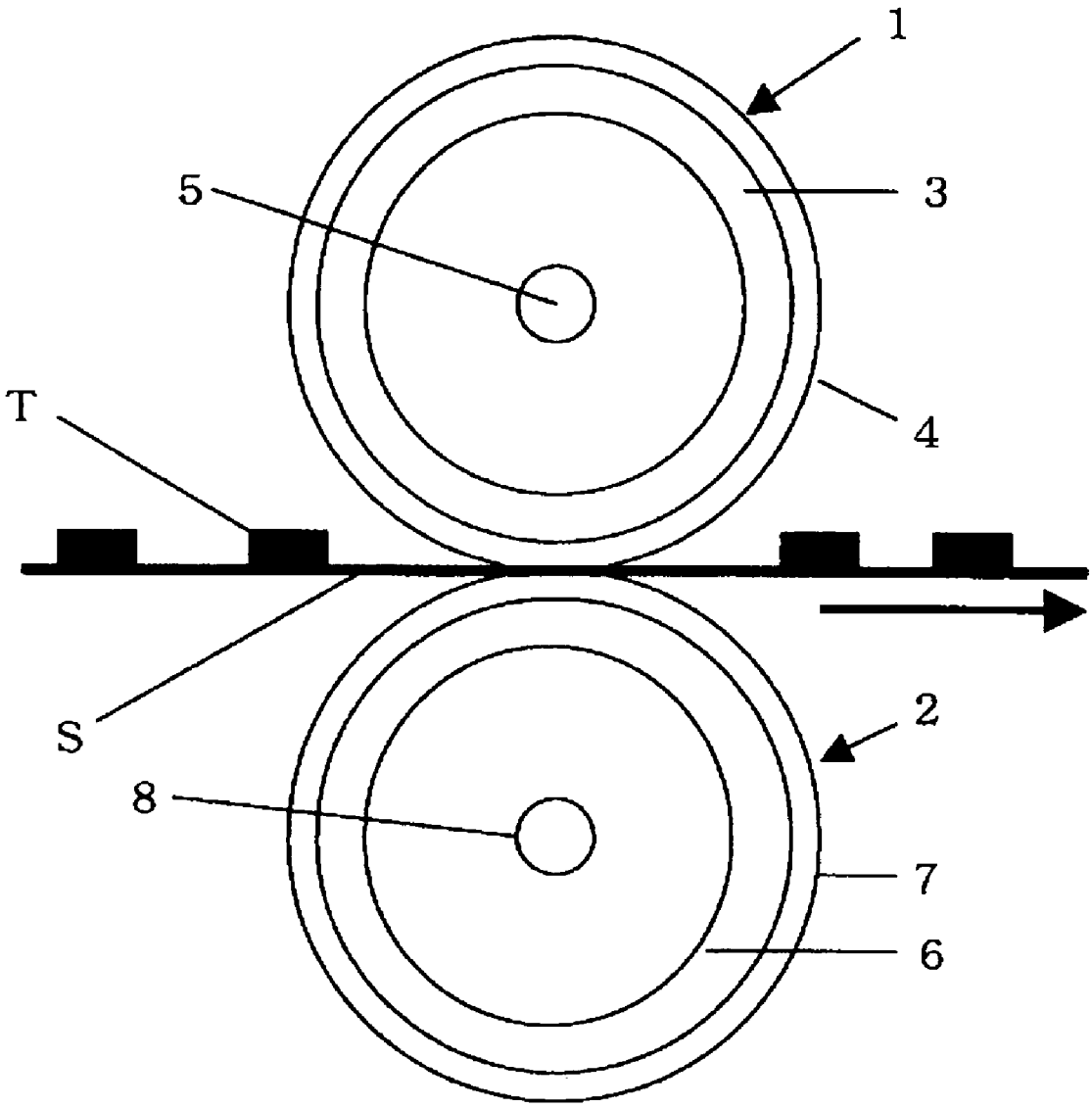
FIG. 1 is a schematic view showing an example of the fixing unit used in the present invention.

In the toner for electrophotography of the present invention, the novel black oxide compound as a colorant, which is used as a substitute for carbon black, is in structure, a polycrystalline particle powder comprising a $Fe_2O_3$—$FeTiO_3$ solid solution. In view of the realizing the low magnetism, high blackness, and good dispersibility and charging performance as required for an adequate substitute for carbon black, the black oxide compound contains 10% by weight to 45% by weight of titanium component calculated in terms of Ti atom in relation to Fe atom when measured by wavelength dispersive X-ray fluorescence spectrometry; having peaks at Bragg angle 2θ to CuKα X-ray of peak A at 32.9 degrees±0.3 degrees and peak B at 35.5 degrees±0.3 degrees; and having the intensity ratio of the CuKα X-ray between peaks A and B (A/B) in the range of 0.3 to 2.0 at a scan speed of 0.5 to 4 degrees/min.

These peaks reflect crystalline structure of the $Fe_2O_3$, and it is important that the intensity ratio between peaks (A/B) is in the range of 0.3 to 2.0 and the crystal faces are those which have developed evenly. When the powder has a structure exhibiting the ratio of more than 2.0, the particles will undergo strong aggregation, and the toner will suffer from poor dispersibility, and hence, reduced fixability. The powder having the structure exhibiting the ratio of less than 0.3 will have low volume resistivity, and the charge will only build up to an insufficient level and/or at an insufficient speed. The peak ratio A/B of 0.3 to 2.0, and preferably 1.6 to 1.8, realizes the good fixability at a low temperature as well as the charge build up to a sufficient level at a sufficient speed.

The black iron oxide compound exhibiting the predetermined X-ray diffraction intensity as described above can be produced, for example, by heating and firing one of a magnetite particle coated with a titanium compound, a mixture of a magnetite particle and a titanium compound, and a reduced powder of a hematite particle coated with a titanium compound, at a temperature of from 700° C. to 1,100° C., and preferably from 800° C. to 1,000° C., in a non-oxidizing atmosphere, and subsequently pulverizing the fired product. As a matter of fact, however, the production of the black iron oxide compound of the present invention exhibiting the predetermined X-ray diffraction intensity has been enabled by controlling the cooling temperature after the firing to an adequate rate. More specifically, when the fired product is slowly cooled at a rate of 400° C./hr or less, the titanium compound coating is likely to become uneven to result in uneven crystal faces, and the product will not exhibit the desired X-ray diffraction intensity. On the other hand, when the fired produced is rapidly cooled at a rate of 1,500° C./hr or higher, the titanium compound coating tends to become detached and production of the product having the desired X-ray diffraction intensity becomes difficult. Use of the magnetite particle coated with a titanium compound for the starting material is preferable in view of producing the non-magnetic product because of the easiness of producing the particles with low value of magnetization.

In the present invention, the structure of the black iron oxide compound may preferably be a polycrystalline particle containing $Fe_2O_3$—$FeTiO_3$ solid solution in view of the blackness thereof and the weak magnetism.

The magnetite particle and the hematite particle may have any desired particle shape including particulate, spherical, and needle shapes. The size thereof is preferably in the range of from 0.03 μm to 1.5 μm.

The particle size of the starting material has correlation with the particle size of the resulting product. Use of a starting material with the small particle size tends to result in the production of the product with the small particle size, and use of a starting material with the large particle size is likely to result in the production of the product with the larger particle size The titanium compound may be any of the hydrous oxide, hydroxide, or oxide of titanium. The titanium compound is preferably a water soluble titanium compound when it is to be mixed with magnetite particles. The titanium compound is preferably used at a content of from 10% by weight to 45% by weight, and more preferably at a content of from 12% by weight to 35% by weight calculated in terms of Ti atom in relation to Fe atom. When the titanium compound of less than 10% by weight is used, the resulting black pigment particles will have an unduly increased value of magnetization, resulting in the reduced developing performance of the toner, and hence, in the reduced image density. When used at a content of more than 45% by weight, the resulting black pigment particles will be non-magnetic. However, the $TiO_2$ generated in a large amount will invite an increased L value (lightness) and reduced tinting strength of the toner.

In the present invention, the titanium component content of the black iron oxide compound calculated in terms of Ti atom in relation to Fe atom measured by wavelength dispersive X-ray fluorescence spectrometry is determined by using a wavelength dispersive X-ray fluorescence spectrometer, and comparing the main peaks in the resulting data.

In the toner of the present invention, the black iron oxide compound is included at a content of from 10% by weight to 30% by weight, and preferably from 15% by weight to 25% by weight.

When the content of the black iron oxide compound is less than 10% by weight, the tinting strength of the toner will be insufficient and the toner will exhibit a somewhat reddish tint, and in addition, a fixing temperature will not be reduced to by a sufficient degree. When the content is in excess of 30% by weight, the specific weight of the toner will be too high and developing performance will be impaired.

In the present invention, the colorant may preferably have a saturation magnetization of from 0.5 emu/g to 30 emu/g.

When the colorant has a saturation magnetization σs of more than 30 emu/g, the toner will be retained too strongly by the toner carrier such as a magnetic sleeve or a magnetic brush having a magnet accommodated in the interior, and development of the image on the photoconductor will be insufficient. In contrast, when the saturation magnetization is less than 0.5 emu/g, the toner will be insufficiently retained by the toner carrier to result in the undesirable splashing and toning.

The saturation magnetization of the colorant is determined from the hysteresis loop obtained by using a magnetization measuring device BHU-60 manufactured by Riken Denshi Co., Ltd. when the toner is filled in a cell having an inner diameter of 7 mm and a height of 10 mm, and the toner is swept with a magnetic field of up to 10 kOe.

In the present invention, the black iron oxide compound in the toner may preferably have an average primary particle size of from 0.05 μm to 2.0 μm, and more preferably, from 0.1 μm to 0.5 μm in view of dispersibility in the toner.

The average primary particle size of the black iron oxide compound is the average value of the measurements obtained from an electron micrograph taken by transmission electron microscope H-9000 manufactured by Hitachi High-Technologies Corporation.

In the method as described above, the particles of the starting material may be optionally coated with a known anti-sintering agent before the firing. In such a case, sintering of the independent particles as well as sintering of aggregated particles can be prevented, and the resulting black pigment particles will attain an excellent dispersibility. The anti-sintering agent which does not adversely affect various advantageous properties of the black pigment particle of interest may be a compound comprising one or two elements selected from Al, Ti, Si, Zr, and P. Typically, the anti-sintering agent may be used at an amount of from 0.1% by atom to 15.0% by atom in relation to the Fe and Ti. In order to achieve sufficient anti-sintering effects, the anti-sintering agent is preferably used at an amount of 0.1% by atom or more, whereas use of the anti-sintering agent of more than 15.0% by atom will result in the presence of the magnetite in the resulting black pigment particles rendering the production of the non-magnetic black iron oxide compound difficult.

In order to enhance the black color, a black dye/pigment or a blue dye/pigment may be immobilized on the surface of the black pigment particle by Mechanomil (manufactured by Okada Seiko Co., Ltd.) or Mechanofusion System (manufactured by Hosokawa Micron Corporation.

Non-limiting exemplary black dye/pigments include iron black, anilin black, graphite, and fullerene, and non-limiting exemplary blue dye/pigments include cobalt blue, alkali blue, victorian blue lake, phthalocyanine blue, metal-free phthalocyanine blue, partially chlorinated phthalocyanine blue, fast sky blue, and indanthren blue BC.

The binder resin used for the toner of the present invention has the characteristic feature that the binder resin comprises two resins having mutually different softening points, that is, a resin (A) and a resin (B). Further energy saving is realized when the resin (A) and the resin (B) has the softening points Tm(A) and Tm(B) and the glass transition temperatures Tg(A) and Tg(B) respectively, and which satisfy the relations:

$$Tm(A)>Tm(B),$$

$$|Tg(A)-Tg(B)|<10^\circ \text{ C., and}$$

$$30\leqq Tm(A)-Tm(B)\leqq 60^\circ \text{ C.}$$

When two resins each having different softening point are used in the conventional toner using carbon black, cracking of the resin becomes difficult due to the softness of the resin and good compatibility of the polymers. This invited poor productivity, and high temperature storage life also becomes insufficient. However, in the case of the toner of the present invention including the black iron oxide compound, the pulverizability is sufficient because of the crack surface formed between the black iron oxide compound and the resins. Furthermore, the black iron oxide compound has superior thermal conductivity compared to carbon black, and the fixability is thereby improved. Still further, the toner of the present invention having the intensity ratio in the X-ray diffraction within the predetermined range exhibits good dispersibility, and hence, high filler performance. Such toner also exhibits an improved hardness, and this is advantageous for the high temperature storage life and resistance to offset at high temperature. In addition, in the case of such toner, the black iron oxide compound gives hazardous effects to the resins in the course of kneading, and dispersibility between the resins and from release agent and other materials is thereby improved, and this advantageously acts on the improvement of dispersibility and anti-fog performance of the toner.

The absolute value of "Tg(A)−Tg(B)" is preferably less than 10° C. When this value is 10° C. or more, compatibility in the kneading of the toner will be insufficient, and simultaneous realization of the low temperature fixability and hot offset resistance will be difficult. This value is preferably 7° C. or less.

The "Tm(A)−Tm(B)" is preferably in the range of from 30° C. to 60° C. in order to simultaneously realize the low temperature fixability and hot offset resistance, and secure a sufficient temperature range for fixing to be carried out. The "Tm(A)−Tm(B)" is more preferably in the range of from 35°

C. to 55° C., and even more improved low temperature fixability is realized when the resins used are polyester resins.

The softening point Tm of the binder resin is measured in accordance with the method described in JIS K72101 by using Capillary Rheometer Shimazu Flowmeter (manufactured by Shimadzu Corporation). More specifically, a sample of 1 $cm^3$ is pushed out of a nozzle having a diameter of 1 mm and a length of 1 mm by pushing the plunger with a load of 20 $Kg/cm^2$ while heating the resin at a temperature rise rate of 6° C./min to thereby depict a curve by plotting the plunger movement in relation to the temperature. In the thus depicted sigmoid curve having a height of h, the temperature corresponding to h/2 (the temperature when half of the resin has gone through the nozzle) is designated the softening point Tm.

The glass transition temperature Tg of the binder resin is measured with a differential scanning calorimeter DSC-60 manufactured by Shimadzu Corporation by heating the resin from room temperature to 200° C. at a rate of 10° C./min, cooling to room temperature at rate of 10° C./min, and further heating at a rate of 10° C./min to thereby depict a curve extending between the base line below the glass transition temperature and the base line above the glass transition temperature at a height h from the base line below the glass transition temperature. The temperature corresponding to h/2 was designated the glass transition temperature Tg.

The toner may preferably have a volume average particle size of from 4 μm to 7.5 μm, and a particle size distribution such that the particles with the particle size of 5 μm or less comprise 60% by number to 80% by number, because such toner exhibits good reproducibility of thin lines.

When the volume average particle size is less than 4 μm, the toner will suffer from phenomena such as reduced transfer efficiency, and increased difficulty of blade cleaning.

On the other hand, when the volume average particle size is more than 7.5 μm, the prevention of the toner scattering beyond letters and lines will be difficult.

When the particles with the particle size of 5 μm or less comprise less than 60% by number, reproducibility of fine lines will be insufficient.

On the other hand, when the particles with the particle size of 5 μm or less comprise more than 80% by number, the excessive fine powders will invite poor attachment to the developing sleeve.

The formulation of the toner of the present invention includes a charge control agent for the purpose of controlling the polarity. Exemplary charge control agents include nigrosine dyes, quaternary ammonium salts, amino group-containing polymers, metal-containing azo dyes, complex compounds of salicylic acid, and phenol compounds. The preferred among these are zirconium compounds comprising zirconium and an aromatic hydroxycarboxylic acid or a salt thereof, since zirconium compounds are capable of building up a sufficient amount of charge at a sufficient speed, and at the same time, will undergo an interaction between the zirconium and the black iron oxide compound of the present invention resembling a metal crosslinking to realize a filler effect, thereby improving high temperature storage life of the toner.

The binder resin used in the toner of the present invention may be any of the resins known in the art including polystyrene, poly-α-stilstyrene, styrene-chlorostyrene copolymer, styrene-propylene copolymer, styrene-butadiene copolymer, styrene-vinyl chloride copolymer, styrene-vinyl acetate copolymer, styrene-maleic acid copolymer, styrene acrylic acid ester copolymer, styrene-methacrylic acid ester copolymer, styrene-α-methyl chloroacrylate copolymer, styrene-acrylonitrile-acrylate copolymer (single polymer or copolymer containing styrene or styrene substituent), polyester resin, epoxy resin, vinyl chloride resin and rosin-modified maleic resin, phenol resin, polyethylene resin, polypropylene resin, petroleum resin, polyurethane resin, ketone resin, ethylene-ethylacrylate copolymer, xylene resin and polyvinyl butylate resin. Among these, the preferred are polyester resins since the resulting resin will be imparted with an improved fixing performance as described above.

Polyester resin is obtained by condensation polymerization of alcohol component and a carboxylic acid component. The alcohol component used may for example be a glycol such as ethylene glycol, a diene glycol, triethylene glycol or propylene glycol. In addition, 1,4-bis (hydroxymeta) cyclohexane and etherated bisphenols such as bisphenol A, divalent alcohol monomers, or trivalent or higher polyalcohol monomers may be mentioned. Examples of the carboxylic acid components are maleic acid, fumaric acid, phthalic acid, isophthalic acid, terephthalic acid, succinic acid, and other divalent organic acid monomers. In addition, examples are malonic acid, or 1,2,4-benzene tricarboxylic acid, 1,2,5-benzene tricarboxylic acid, 1,2,4-cyclohexane carboxylic acid, 1,2,4-naphthalene tricarboxylic acid and 1,2,5-hexane tricarboxylic acid, 1,3-dicarboxyl-2-methylene carboxypropane, and 1,2,7,8-octane tetracarboxylic acid, and other tribasic or higher polybasic carboxylic acid monomers.

The polyester resin may preferably have a glass transition temperature Tg of from 58° C. to 75° C.

The above resins can be used alone, but two or more can also be used together.

There is no particular limitation on the resin manufacturing method, i.e., block polymerization, solution polymerization, emulsion polymerization and suspension polymerization.

A wax component can also be used in the present invention for the purpose of improving releasability upon fixing. Exemplary wax which can be used include polyolefin wax such as polypropylene wax and polyethylene wax and natural waxes such as candelilla wax, rice wax, and carnauba wax.

The wax component is preferably added at an amount of 0.5 parts by weight to 10 parts by weight with respect to 100 parts by weight of the binder resin.

If desired, the toner as described above may be admixed with other additives such as silica, aluminum oxides, and titanium oxides. When improvement of fluidity is the main object, the additive may be appropriately selected from hydrophobicized silica or titanium oxide in the form of rutile fine particles having an average primary particle size of preferably from 0.001 μm to 1 μm, and more preferably from 0.005 μm to 0.1 μm. Particularly preferred are silica and titania which have been surface treated with an organosilane, and these may be used at a proportion of 0.1% by weight to 5% by weight, and preferably at 0.2% by weight to 2% by weight.

The toner of the present invention can be used as a one-component dry toner, or in the form of a two-component dry toner after mixing with a carrier.

The carrier which can be used when the toner of the present invention is used in the form of a two-component dry toner may be adequately selected from powders containing glass, iron, ferrite, nickel, zirconium, silica, or the like as the main component and having a particle size of from 30 μm to 1,000 μm, or alternatively, from those comprising the core of such particle and a coating of styrene-acryl resin, silicone resin, polyamide resin, polyvinylidene fluoride resin, or the like.

[Manufacturing Process of Toner]

The process which can be used for manufacturing the toner of the present invention comprises the steps of: mechanically mixing the toner components comprising the binder resin, the charge control agent, and the black iron oxide compound; melt kneading the mixture; pulverizing the kneaded mixture; and classifying the pulverized mixture. Also applicable is the process wherein the powders produced in the pulverization and classification steps that are not used for the final product are recycled to the mixing or melt kneading steps.

In the present invention, "the powders produced in the pulverization and classification steps that are not used for the final product" (i.e. byproducts) include the fine and coarse particles obtained in the pulverization step after the melt kneading step that does not fall within the desired particle size range, and the fine and coarse particles generated in the subsequent classification step that does not fall within the desired particle size range. Preferably, such byproducts are incorporated in the mixing or melt kneading step at a weight ratio of the byproducts to other starting materials of 1:99 to 50:50.

The steps of mechanically mixing the toner components comprising the binder resin, the main charge control agent, and the black iron oxide compound may be conducted by using a blender normally used in the art wherein the mixing is accomplished by a rotating blade under the conditions normally used in the art. The conditions are not particularly limited.

After the completion of the mixing step, the mixture is introduced in a kneader for melt kneading. The melt kneading may be accomplished in a continuous process by using a single or twin screw kneader, or in a batch process by using a roll mill.

It is important that this melt kneading is conducted under appropriate conditions such that molecular chain of the binder resin is not broken. More specifically, the temperature used in the melt kneading should be determined by taking the softening point of the binder resin into consideration. Use of a melt kneading temperature significantly lower than the softening point may invite severe breakage of the molecular chain. In contrast, use of an excessively high temperature may inhibit the dispersion.

When the melt kneading step is completed, the kneaded mixture is pulverized. In this pulverization step, the mixture is preferably roughly pulverized, and then finely pulverized. The pulverization is preferably accomplished by colliding the materials against a baffle in a jet stream, or by crushing in the narrow gap defined between the mechanically rotated rotor and the stator.

When the pulverization steps is completed, the pulverized product is classified in an air stream, for example, by utilizing centrifugal force to produce a toner having the predetermined particle size, for example, an average particle size of from 5 μm to 20 μm.

When a developer is prepared, the produced toner may be further admixed with an inorganic fine particle such as hydrophobic silica fine particles in order to improve fluidity and storage life, developing performance, and transfer properties of the toner.

The external additive may be mixed using a blender which is generally used in blending powders. The blender, however, is preferably equipped with a jacket or the like to thereby enable control of the interior temperature. The hysteresis of the stress applied to the external additive can be changed by incrementally or gradually introducing the external additive, or of course, by changing the rotation speed, tumbling speed, residence time, temperature of the blender, and the like. The stress applied may be higher at first and lower later, or vice versa.

The mixing device which can be used includes V-blender, rocking mixer, Loedige mixer, nauta mixer, and Henschel mixer.

The measurements were conducted as described below.

The wavelength dispersive X-ray fluorescence spectrometry was conducted in the present invention by a wavelength dispersive X-ray fluorescence spectrometer under the conditions:

voltage: 50 kv, current: 50 mA, with Rh tube, and under vacuum conditions.

The X-ray diffraction was measured in the present invention with CuKα radiation by using RINT1100 (the manufacture: Rigaku Corporation) under the conditions:

the X-ray tube: Cu, tube voltage: 50 KV, tube current: 30 Ma, and scan speed: 2 degrees/min.

An embodiment of the fixing unit used in the present invention is the one shown in FIG. 1 wherein the reference numeral 1 denotes a fixing roller and the reference numeral 2 denotes a pressure roller. The fixing roller 1 is formed of a metal cylinder 3 made of a heat conductive material such as aluminum, iron, stainless or brass, and an offset preventing layer 4 covering the metallic cylinder 3. The offset preventing layer 4 is formed from RTV (a generic term used for room temperature vulcanizing rubbers), silicone rubber, tetrafluoroethylene-perfluoroalkylvinylether (PFA), polytetrafluoroethylene (PTFE), or the like. The fixing roller 1 is provided with a heat lamp 5 in its interior. The pressure roller 2 also comprises a metal cylinder 6, which is most often formed from the material used for the metal cylinder 3 of the fixing roller 1, and the metal cylinder 6 is covered by a offset preventing layer 7 made of PFA, PTFA, or the like. The pressure roller 2 is optionally provided with a heat lamp 8 in its interior.

The fixing roller and the pressure roller are rotatably pressed against each other by springs (not shown) at opposite ends of the rollers.

A substrate S (e.g. a sheet of paper to which the toner image has been transferred) having a toner image T thereon is passed between the fixing roller 1 and the pressure roller 2 to thereby fix the toner image T on the substrate S.

The fixing unit used in the present invention is the one wherein the temperature build up property of the fixing roller has been improved by reducing the thickness of the metal cylinder of the fixing roller to the range of 1.0 mm or lower. Accordingly, the temperature of the fixing roller can be raised to the desired temperature in a very short period.

The metal cylinder may preferably have a thickness of 0.2 mm to 0.7 mm, although the preferred thickness varies with the strength and thermal conductivity of the material used.

The load applied between the fixing roller and the pressure roller (bearing force) is preferably $1.5\times10^5$ Pa or less. This bearing force is the value determined by dividing the load applied to opposite ends of the rollers by the contact area of the rollers.

The contact area of the rollers is determined by passing a sheet such as an OHP sheet whose surface properties significantly change upon heating between the rollers which have reached the temperature at which the fixing is normally conducted, stopping the roller for a few dozen seconds, discharging the sheet, and measuring the area of the sheet where surface properties have changed.

A higher bearing force on the rollers is preferable for the fixing of the toner image. The fixing unit used, however, is the one having the fixing roller with the metal cylinder having a thickness of 1.0 mm or less, and an excessive load will invites deformation of the fixing roller. Accordingly, the load is preferably $1.5\times10^5$ Pa or less, and more preferably in the range of from $0.5\times10^5$ Pa to $1.0\times10^5$ Pa.

Figure 2:
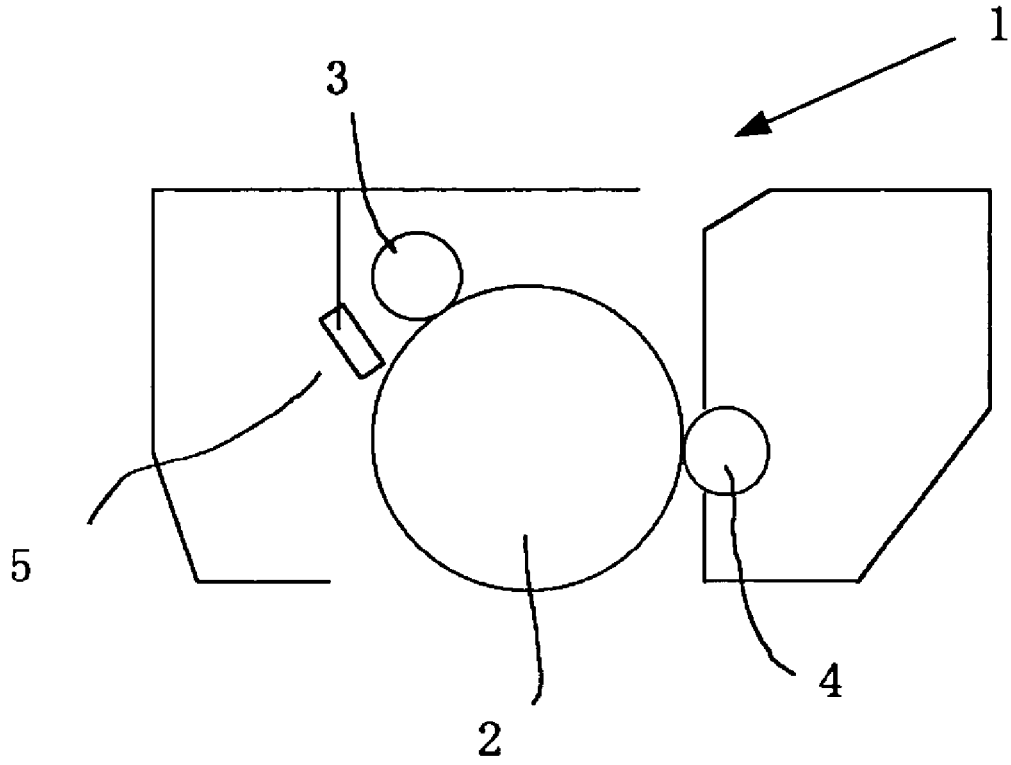
FIG. 2 is a schematic view of an example of the image forming apparatus having the process cartridge of the present invention mounted thereon.

FIG. 2 is a schematic view showing one example of the structure of the image forming apparatus equipped with a process cartridge having the toner of the present invention loaded therein. In FIG. 2, the process cartridge is generally designated by the reference numeral 1. FIG. 2 also shows a photoconductor 2, a charging unit 3, a developing unit 4, and a cleaning unit 5.

In the present invention, of the components of the image forming apparatus such as photoconductor 2, the charging means 3, the developing means 4, and the cleaning means 5 as mentioned above, a plurality of components including at least the developing means 4 are integrally formed with the process cartridge, and such process cartridge assembly can be detachably mounted on the main part of a copying machine, a printer, or other image forming apparatus.

In the image forming apparatus used in the present invention, the photoconductor is rotated at a constant circumferential speed. In the course of its rotation, a uniform charge of positive or negative potential is applied to the circumferential surface of the photoconductor by the charging unit, and an image is then created by irradiating with the light by an irradiating unit such as slit exposure or laser beam scanning exposure means to thereby consecutively create latent electrostatic images on the circumferential surface of the photoconductor. The thus formed latent electrostatic images are subsequently converted into toner images by the developing unit, and the toner images are transferred onto the transfer material which is a substrate supplied from the paper feed unit into the nip between the photoconductor and the transfer unit in synchronization with the rotation of the photoconductor. The transfer material then leaves the photoconductor surface, and enters a fixing unit where the images are fixed. The substrate with the fixed images is then discharged from the apparatus as a printout (photocopy). The surface of the photoconductor after the image transfer is cleaned by a cleaning unit whereby the residual toner is removed, and after further removal of the charge, the photoconductor is ready for the next cycle of image formation.

In the image forming apparatus as described above, the image fixing means preferably comprises the fixing unit wherein the fixing roller has the predetermined thickness of 1.0 mm or less as described above, and the bearing force between the fixing roller and the pressure roller is at the predetermined value of $1.5\times10^5$ Pa or less as described above.

The charging unit preferably is a charging device in which a charging member disposed therein is brought in contact with the photoconductor, and the charging is accomplished by applying a voltage to the charging member. Use of such charging device as the charging unit enables uniform application of the voltage to the developer, which in turn realizes an image with no fog.

Next, the present invention is described in further detail by referring to the Examples which by no means limit the scope of the present invention.

Preparation Examples of Black Iron Oxide Compounds (1) Preparation of Black Iron Oxide Compounds 1 to 4:

Magnetite fine particles comprising magnetite particles coated with titanium hydroxide were fired in nitrogen atmosphere at the firing temperature and the firing time as shown in Table 1. After cooling, the particles were pulverized in a ball mill to obtain the black iron oxide compound.

(2) Preparation of Black Iron Oxide Compounds 5 to 8:

A powder mixture of hematite particles and titanium oxide was fired in nitrogen atmosphere at the firing temperature and the firing time as shown in Table 1. After cooling, the particles were pulverized in a ball mill to obtain the black iron oxide compound.

(3) Production of Black Iron Oxide Compounds 9 to 13:

Hematite fine particles comprising hematite particles coated with titanium hydroxide were reduced, and the obtained reduced powder was fired in nitrogen atmosphere at the firing temperature and the firing time as shown in Table 1. After cooling, the particles were pulverized in a ball mill, and a blue dye/pigment (metal free phthalocyanine blue) was immobilized on the surface of the black pigment particles by using Mechanofusion System manufactured by Hosokawa Micron Corporation.

Preparation conditions and physical properties for each black iron oxide compounds are shown in Table 1, below.

TABLE 1

| | Coating weight of Ti compound (wt %) | Firing temp. (° C.) | Firing time (min.) | Cooling rate (° C./hr) | Average primary particle size (μm) |
|---|---|---|---|---|---|
| Black iron oxide compound No. 1 | 10 | 800 | 120 | 400 | 0.02 |
| Black iron oxide compound No. 2 | 10 | 1000 | 100 | 1500 | 2.2 |
| Black iron oxide compound No. 3 | 45 | 900 | 120 | 450 | 2.5 |
| Black iron oxide compound No. 4 | 45 | 700 | 120 | 600 | 0.04 |
| Black iron oxide compound No. 5 | 35 | 850 | 110 | 1200 | 0.05 |
| Black iron oxide compound No. 6 | 20 | 950 | 100 | 1400 | 2.0 |
| Black iron oxide compound No. 7 | 12 | 820 | 110 | 1000 | 1.5 |
| Black iron oxide compound No. 8 | 28 | 760 | 120 | 900 | 0.2 |
| Black iron oxide compound No. 9 | 16 | 880 | 120 | 800 | 0.9 |
| Black iron oxide compound No. 10 | 6 | 900 | 100 | 600 | 1.5 |
| Black iron oxide compound No. 11 | 52 | 860 | 120 | 1200 | 0.08 |
| Black iron oxide compound No. 12 | 30 | 950 | 120 | 350 | 1.1 |
| Black iron oxide compound No. 13 | 22 | 800 | 120 | 1550 | 1.9 |

*calculated in terms of Ti atom in relation to Fe atom.

EXAMPLE 1

| [Toner Formulation] | |
|---|---|
| Styrene-n-butylacrylate copolymer (Tm: 155° C., Tg: 63° C.) | 70 parts by weight |
| Black iron oxide compound 1 | 25 parts by weight |
| Carnauba wax | 4 parts by weight |
| Charge control agent (chromium azo dye) | 1 part by weight |

The formulation was kneaded in a twin screw extruder, pulverized, and classified to obtain a powder having a weight average particle size of 5 μm. The powder was then mixed with 0.5 parts by weight of a silica fine powder (R-972, manufactured by Client Japan) in a Henschel mixer to obtain the toner.

The obtained toner was mixed with a carrier comprising ferrite particles having an average particle size of 50 μm coated with a silicone resin at a toner concentration of 4.0% by weight to produce the developer.

(1) Evaluation of Fixability

A fixer unit having the constitution as shown in FIG. 1 (bearing force: $0.7\times10^5$ Pa) was mounted on IMAGIO MF655 manufactured by Ricoh Co., Ltd. An image was copied at different heater temperatures to obtain a fixed image.

A mending tape (manufactured by 3M) was attached on the fixed image, and after applying a predetermined constant pressure, the tape was peeled. The image was measured for its image density before and after the tape application and peeling Fixability (%)=(image density after the tape peeling/image density before the tape attachment)×100

(2) Evaluation of High Temperature Storage Life

The toner was filled in a 50 cc glass container, and placed in a thermostat bath at 60° C. for 4 hours. The toner was then cooled to room temperature, and the penetration thereof was measured in the penetration test (JIS K2235-1991). A larger value of penetration corresponds to a superior high temperature storage life.

(3) Evaluation of Image Quality

Copies were taken on IMAGIO 420 manufactured by Ricoh Co., Ltd., at normal temperature and normal humidity (at 18° C. to 27° C. and 30% RH to 70% RH), and the image of the initial copy and the image of the copy after producing 50,000 copies were used for evaluation of the fog and the image density.

The fog was determined comprehensively according to the following criteria:

A: excellent, no fog,

B: good, slight fog,

C: fair, substantial fog with no practical problem, and

D: poor, serious fog.

The image density was measured with a Macbeth Densitometer. A higher image density indicates a higher tinting strength.

(4) Evaluation of X-ray Diffraction

X-ray diffraction was evaluated with CuKα radiation by using RINT1100 manufactured by Rigaku Corporation.

The X-ray tube: Cu, tube voltage: 50 KV, tube current: 30 Ma, scan speed: 2 degrees/min.

[Evaluation of Physical Properties of Black Iron Oxide]

(5) Average Primary Particle Size

An electron micrograph was taken by transmission electron microscope H-9000 manufactured by Hitachi High-Technologies Corporation, and average primary particle size was determined from the average value measured from the electron micrograph.

(6) Magnetic Properties

Magnetic properties were measured with a magnetization measuring device BHU-60 manufactured by Riken Denshi Co., Ltd. The toner was filled in a cell having an inner diameter of 7 mm and a height of 10 mm, and the toner was swept with a magnetic field of up to 10 kOe. Saturation magnetization, residual magnetization, and coercive force were determined from the resulting hysteresis loop.

The results of the evaluation are shown in Table 4.

EXAMPLES 2 to 6

Toners were prepared by repeating the procedure of Example 1 except that the black iron oxide compound used was replaced with those indicated in Table 2, below.

TABLE 2

| Example 2 | Example 3 | Example 4 | Example 5 | Example 6 |
|---|---|---|---|---|
| Black iron oxide compound No. 2 | Black iron oxide compound No. 3 | Black iron oxide compound No. 4 | Black iron oxide compound No. 5 | Black iron oxide compound No. 6 |

EXAMPLE 7

| [Toner Formulation] | |
|---|---|
| Styrene-n-BMA-2EHA copolymer (Tm: 150° C., Tg: 62° C.) | 30 parts by weight |
| Styrene-n-butylacrylate copolymer (Tm: 99° C., Tg: 68° C.) | 40 parts by weight |
| Black iron oxide compound 7 | 23 parts by weight |
| Carnauba wax | 5 parts by weight |
| Charge control agent (chromium azo dye) | 2 part by weight |

The formulation was kneaded in a twin screw extruder, pulverized, and classified to obtain a powder having a weight average particle size of 5 μm. The powder was then mixed with 1 part by weight of a silica fine powder (R-972, manufactured by Client Japan) in a Henschel mixer to obtain the toner.

In the formulation as described above, "n-BMA" denotes n-butylmethacrylate, and "2EHA" denotes 2-ethylhexylacrylate.

EXAMPLE 8

| [Toner Formulation] | |
|---|---|
| Polyester (Tm: 148° C., Tg: 64° C.) | 30 parts by weight |
| Polyester (Tm: 100° C., Tg: 60° C.) | 40 parts by weight |

-continued

| [Toner Formulation] | |
|---|---|
| Black iron oxide compound 8 | 23 parts by weight |
| Carnauba wax | 5 parts by weight |
| Charge control agent (chromium azo dye) | 2 part by weight |

The formulation was kneaded in a twin screw extruder, pulverized, and classified to obtain a powder having a weight average particle size of 6 μm. The powder was then mixed with 0.7 parts by weight of a silica fine powder (R-972, manufactured by Client Japan) in a Henschel mixer to obtain the toner.

EXAMPLE 9

| [Toner Formulation] | |
|---|---|
| Polyester (Tm: 152° C., Tg: 60° C.) | 35 parts by weight |
| Polyester (Tm: 99° C., Tg: 65° C.) | 35 parts by weight |
| Black iron oxide compound 9 | 25 parts by weight |
| Carnauba wax | 4 parts by weight |
| Charge control agent (a zirconium compound containing 5-methoxy-salicylic acid) | 1 part by weight |

The formulation was kneaded in a twin screw extruder, pulverized, and classified to obtain a powder having a weight average particle size of 5.5 μm. The powder was then mixed with 1 part by weight of a silica fine powder (R-972, manufactured by Client Japan) in a Henschel mixer to obtain the toner.

Comparative Examples 1 to 4

[Toner Formulation]

Toners were prepared by repeating the procedure of Example 9 except that the black iron oxide compound used was replaced with those indicated in Table 3, below.

TABLE 3

| Comparative Example 1 | Comparative Example 2 | Comparative Example 3 | Comparative Example 4 |
|---|---|---|---|
| Black iron oxide compound No. 10 | Black iron oxide compound No. 11 | Black iron oxide compound No. 12 | Black iron oxide compound No. 13 |

The toners produced in Examples 2 to 9 and Comparative Example 1 to 4 were evaluated by repeating the procedure of Example 1. The results of the evaluation were as shown in Table 4.

TABLE 4

| | Example | | | | | | | | | Comparative Example | | | |
|---|---|---|---|---|---|---|---|---|---|---|---|---|---|
| | 1 | 2 | 3 | 4 | 5 | 6 | 7 | 8 | 9 | 1 | 2 | 3 | 4 |
| X-ray intensity ratio between toner peaks A and peak B | 0.3 | 2.0 | 0.3 | 2.0 | 1.8 | 0.6 | 1.5 | 1.3 | 1.0 | 0.9 | 1.6 | 0.1 | 2.8 |
| Saturation magnetization of colorant (emu/g) | 33 | 0.4 | 30 | 0.5 | 28 | 1.8 | 9.5 | 16 | 20 | 25 | 10 | 0.9 | 1.2 |
| Fixing temp. (° C.) | 160 | 160 | 160 | 160 | 160 | 160 | 145 | 130 | 130 | 130 | 130 | 130 | 185 |
| High temp. storage life (mm) | 22 | 21 | 23 | 23 | 25 | 20 | 24 | 25 | 30 | 28 | 32 | 30 | 32 |
| Fog (after 50,000 copies) | C | C | B | B | A | A | A | A | A | C | D | D | C |
| Image density (after 50,000 copies) | 1.36 | 1.39 | 1.42 | 1.39 | 1.42 | 1.41 | 1.40 | 1.42 | 1.41 | 1.11 | 1.42 | 1.29 | 1.35 |

The present invention provides a toner for electrophotography, and the toner simultaneously exhibits excellent fixability, high temperature storage life, low fog, and high image density.

The present invention also provides an image fixing process using the above-mentioned toner, and the image fixing process exhibits high thermal energy efficiency as well as excellent fixability at low temperature.

The present invention also provides a process cartridge for use with such a toner, an image forming apparatus for use with such a toner, and an image forming process using such a toner

What is claimed is:

1. A toner for electrophotography comprising:

a binder resin;

a charge control agent; and a colorant, wherein the colorant is a black iron oxide compound containing from 10% by weight to 45% by weight of titanium component calculated in terms of Ti atom in relation to Fe atom when measured by wavelength dispersive X-ray fluorescence spectrometry, and wherein peaks at Bragg angle 2θ of the toner to CuKα X-ray are peak A at 32.9 degrees ±0.3 degrees and peak B at 35.5 degrees ±0.3 degrees, and the intensity ratio of the CuKα X-ray between peaks A and B (A/B) is in the range of 0.3 to 2.0 at a scan speed of 0.5 degrees/min to 4 degrees/min.

2. A toner for electrophotography according to claim 1, wherein the colorant is a black iron oxide compound containing from 12% by weight to 35% by weight of titanium component calculated in terms of Ti atom in relation to Fe atom when measured by wavelength dispersive X-ray fluorescence spectrometry.

3. A toner for electrophotography according to claim 1, wherein the intensity ratio of the CuKα X-ray between peaks A and B (A/B) is in the range of from 0.6 to 1.8.

4. A toner for electrophotography according to claim 1, wherein the colorant has a saturation magnetization σs of from 0.5 emu/g to 30 emu/g.

5. A toner for electrophotography according to claim 1, wherein the black iron oxide compound has an average primary particle size of from 0.05 μm to 2.0 μm.

6. A toner for electrophotography according to claim 1, wherein the black iron oxide compound has at least one of a black dye, a black pigment, a blue dye and a blue pigment immobilized on the surface thereof.

7. A toner for electrophotography according to claim 1, wherein the toner has the black iron oxide compound content of from 10% by weight to 30% by weight.

8. A toner for electrophotography according to claim 7, wherein the toner has the black iron oxide compound content of from 15% by weight to 25% by weight.

9. A toner for electrophotography according to claim 1, wherein the binder resin comprises a resin (A) and a resin (B), having mutually different softening points, the resin (A) and the resin (B) respectively have softening points Tm(A) and Tm(B), and glass transition points Tg(A) and Tg(B), satisfying the following relations:

$$Tm(A)>Tm(B);$$

$$|Tg(A)-Tg(B)|<10^\circ\ \text{C.; and}$$

$$30\leqq Tm(A)-Tm(B)\leqq 60^\circ\ \text{C.}$$

10. A toner for electrophotography according to claim 9, wherein the softening points Tm(A) and Tm(B) and the glass transition points Tg(A) and Tg(B) satisfy the following relations:

$$|Tg(A)-Tg(B)|<7^\circ\ \text{C.; and}$$

$$35\leqq Tm(A)-Tm(B)\leqq 55^\circ\ \text{C.}$$

11. A toner for electrophotography according to claim 1, wherein the binder resin comprises a polyester resin.

12. A toner for electrophotography according to claim 1, wherein the charge control agent comprises a zirconium compound which comprises zirconium and one of aromatic hydroxycarboxylic acid and a salt thereof.

13. A toner for electrophotography according to claim 1, wherein the toner has a volume average particle size of 4 μm to 7.5 μm, and the toner has 60% by number to 80% by number of toner particles having a particle size of 5 μm or less.

14. An image fixing process comprising the step of:

passing a substrate bearing a toner image on the surface thereof between two rollers, one of the two rollers being a fixing roller that becomes in contact with the toner image-bearing surface of the substrate, to thereby fix the toner image on the substrate, wherein the toner image is formed a toner which comprises a binder resin, a charge control agent, and a colorant, the colorant is a black iron oxide compound containing from 10% by weight to 45% by weight of titanium component calculated in terms of Ti atom in relation to Fe atom when measured by wavelength dispersive X-ray fluorescence spectrometry; and peaks at Bragg angle 2θ of the toner to CuKα X-ray are peak A at 32.9 degrees ±0.3 degrees and peak B at 35.5 degrees ±0.3 degrees, and the intensity ratio of the CuKα X-ray between peaks A and B (A/B) is in the range of 0.3 to 2.0 at a scan speed of 0.5 to 4 degrees/min, and wherein the two rollers are applied with a bearing force (load applied to the rollers/contact area) of $1.5\times10^5$ Pa or less, and the fixing roller has a thickness of 1.0 mm or less.

15. An image forming process comprising the steps of:

charging a photoconductor;

irradiating the photoconductor imagewise with light so as to form a latent electrostatic image thereon;

developing the latent electrostatic image using a toner so as to form a toner image;

transferring the toner image on the photoconductor to a substrate so as to bear the toner image on the surface of the substrate; and passing the substrate bearing the toner image between two rollers, one of the two rollers being a fixing roller that becomes in contact with the toner image-bearing surface of the substrate, to thereby fix the toner image on the substrate, wherein the toner is a toner comprises a binder resin, a charge control agent, and a colorant, the colorant is a black iron oxide compound containing from 10% by weight to 45% by weight of titanium component calculated in terms of Ti atom in relation to Fe atom when measured by wavelength dispersive X-ray fluorescence spectrometry; and peaks at Bragg angle 2θ of the toner to CuKα X-ray are peak A at 32.9 degrees ±0.3 degrees and peak B at 35.5 degrees ±0.3 degrees, and the intensity ratio of the CuKα X-ray between peaks A and B (A/B) is in the range of 0.3 to 2.0 at a scan speed of 0.5 to 4 degrees/min, and wherein the two rollers are applied with a bearing force (load applied to the rollers/contact area) of $1.5\times10^5$ Pa or less, and the fixing roller has a thickness of 1.0 mm or less.

16. An image forming process comprising the steps of contacting a charging member disposed in a charging unit with a photoconductor and applying a voltage to the charging member so as to charge the photoconductor;

irradiating the photoconductor imagewise with the light so as to form a latent electrostatic image thereon;

applying a toner to the photoconductor so as to develop the latent electrostatic image with forming a toner image;

transferring the toner image on the photoconductor to a substrate; and heating and pressurizing the substrate bearing the toner image so as to fix the toner image on the substrate, wherein the toner is a toner which comprises a binder resin, a charge control agent, and a colorant, the colorant is a black iron oxide compound containing from 10% by weight to 45% by weight of titanium component calculated in terms of Ti atom in relation to Fe atom when measured by wavelength dispersive X-ray fluorescence spectrometry; and peaks at Bragg angle 2θ of the toner to CuKα X-ray are peak A at 32.9 degrees ±0.3 degrees and peak B at 35.5 degrees ±0.3 degrees, and the intensity ratio of the CuKα X-ray between peaks A and B (A/B) is in the range of 0.3 to 2.0 at a scan speed of 0.5 to 4 degrees/min.

17. An image forming apparatus comprising:

a photoconductor;

a charging unit configured to charge the photoconductor;

an irradiating unit configured to irradiate the charged photoconductor imagewise with light so as to form a latent electrostatic image on the photoconductor;

a developing unit housing a toner therein, configured to develop the latent electrostatic image using the toner so as to form a toner image;

a transferring unit configured to transfer the toner image on the photoconductor to a substrate; and a fixing unit comprising two rollers, configured to pass the substrate bearing the toner image between the two rollers so as to fix the toner image on the substrate, wherein the toner is a toner which comprises a binder resin, a charge control agent, and a colorant, the colorant is a black iron oxide compound containing from 10% by weight to 45% by weight of titanium component calculated in terms of Ti atom in relation to Fe atom when measured by wavelength dispersive X-ray fluorescence spectrometry; and peaks at Bragg angle 2θ of the toner to CuKα X-ray are peak A at 32.9 degrees ±0.3 degrees and peak B at 35.5 degrees ±0.3 degrees, and the intensity ratio of the CuKα X-ray between peaks A and B (A/B) is in the range of 0.3 to 2.0 at a scan speed of 0.5 to 4 degrees/min, and wherein the two rollers are applied with a bearing force (load applied to the rollers/contact area) of $1.5\times10^5$ Pa or less, one of the two rollers is a fixing roller has a thickness of 1.0 mm or less, and the fixing roller is subjected to a contact with the toner image bearing surface of the substrate when the substrate is passed through between the two rollers.

18. A process cartridge comprising:

a photoconductor; and at least one unit selected from:

a charging unit configured to charge the photoconductor;

a developing unit housing a toner therein, configured to develop a latent electrostatic image formed on the photoconductor using the toner so as to form a toner image; and a cleaning unit comprising a cleaning blade, configured to remove the residual toner on the photoconductor using the cleaning blade after the toner image is transferred from the photoconductor, so as to clean the photoconductor, wherein the process cartridge is detachably mountable to a main body of an image forming apparatus, and wherein the toner is a toner which comprises a binder resin, a charge control agent, and a colorant, the colorant is a black iron oxide compound containing from 10% by weight to 45% by weight of titanium component calculated in terms of Ti atom in relation to Fe atom when measured by wavelength dispersive X-ray fluorescence spectrometry; and peaks at Bragg angle 2θ of the toner to CuKα X-ray are peak A at 32.9 degrees ±0.3 degrees and peak B at 35.5 degrees ±0.3 degrees, and the intensity ratio of the CuKα X-ray between peaks A and B (A/B) is in the range of 0.3 to 2.0 at a scan speed of 0.5 to 4 degrees/min.

* * * * *